United States Patent [19]

Gordon

[11] 4,002,964

[45] Jan. 11, 1977

[54] TEMPERATURE COMPENSATION TECHNIQUE

[75] Inventor: Bernard M. Gordon, Magnolia, Mass.

[73] Assignee: Gordon Engineering Company, Wakefield, Mass.

[22] Filed: Oct. 2, 1975

[21] Appl. No.: 618,784

[52] U.S. Cl. ..... 323/16; 323/68; 323/75 F

[51] Int. Cl.[2] ..... G12B 7/00

[58] Field of Search ..... 307/310; 323/16, 19, 323/40, 68, 69, 75 F, 75 H, 75 N

[56] References Cited

UNITED STATES PATENTS

| | | | |
|---|---|---|---|
| 3,293,540 | 12/1966 | Silard et al. | 323/68 |
| 3,488,529 | 1/1970 | Howe | 307/310 |

*Primary Examiner*—A. D. Pellinen
*Attorney, Agent, or Firm*—Weingarten, Maxham & Schurgin

[57] ABSTRACT

A temperature compensation system and technique requiring no measurement of actual temperature differential and wherein each source of thermal error in an electronic circuit can be corrected in addition to overall thermal error. Two reference voltages are provided having equal and opposite temperature response and having a null value at selected normal temperature. A respective correcting voltage is derived from the two reference voltages for each source of thermal error and each of magnitude and polarity to compensate for the corresponding thermal error. A correcting voltage can also be derived for compensation of overall residual thermal error.

9 Claims, 3 Drawing Figures

TEMPERATURE COMPENSATION TECHNIQUE

FIELD OF THE INVENTION

This invention relates to temperature compensation techniques and more particularly to a technique and system for compensating for temperature variations in electronic circuits.

BACKGROUND OF THE INVENTION

Electronic circuits are often temperature sensitive by reason of the variation of device parameters with operating temperature. Compensation for thermal variations has generally been accomplished by employing thermal devices such as thermistors having a thermal response complementary to the response to be compensated such that an offsetting variation is provided to minimize or cancel out the resultant thermal variation. The actual operating temperature of a circuit must usually be determined in order for appropriate compensation to be provided by incorporation of a thermistor or like device of opposite thermal response.

SUMMARY OF THE INVENTION

Briefly, the present invention provides a temperature compensation system and technique requiring no measurement of actual temperature differential and providing a high order of correction at relatively low cost. Each source of thermal error in an electronic circuit is corrected as is the overall thermal error. According to the invention, two reference voltages are provided having equal and opposite temperature response and having a null value at a selected normal temperature, typically room temperature. A respective correcting voltage is derived from the two reference voltages for each source of thermal error, each of magnitude and polarity to compensate for the corresponding thermal error. A correcting voltage can also be derived for compensation of overall residual thermal error. The compensating voltage is varied as applied to the circuit being corrected until the intended value is determined at which correction is achieved. The thermal compensation does not affect the operation or calibration of the circuit being thermally corrected.

In typical implementation, the compensating voltages can be derived from the first and second reference voltages by an array of potentiometers having their resistance elements connected to the two reference voltages with the variable taps providing the correcting voltages. The potentiometers can be adjusted to provide the intended values for the associated circuit. Alternatively, after a particular value has been determined, a fixed resistance can be provided with the associated circuit to yield the intended correction or a circuit resistance can be trimmed to yield the corrected value. A resistance adjustment can be provided for each source of thermal error in an operating circuit and in addition correction for overall circuit thermal error can be provided to achieve thermal stability of great accuracy.

The invention is useful with a wide variety of circuits and apparatus in which the electrical response is thermally sensitive such that a correcting voltage can be applied to the circuit or apparatus in question for compensation of the thermal error.

DESCRIPTION OF THE DRAWINGS

The invention will be more fully understood from the following detailed description taken in conjunction with the accompanying drawings in which.

DETAILED DESCRIPTION OF THE INVENTION

Figure 1:
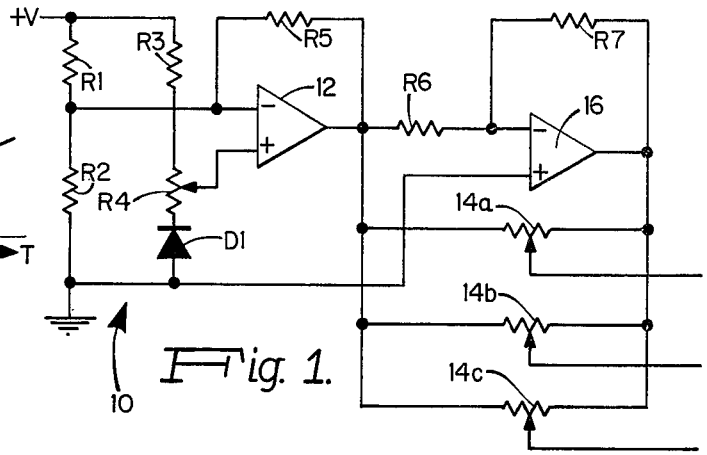
FIG. 1 is a schematic representation of a temperature compensation circuit according to the invention.

A temperature compensation circuit according to the invention is shown in FIG. 1 and includes a bridge network comprising resistors R1, R2, R3 and R4 providing the four bridge arms and connected between a source of positive potential +V and ground. A diode D1 is connected in the bridge arm containing resistor R4 and serves as the temperature sensing element. The resistor R4 is a potentiometer, the movable contact of which is coupled to the positive input of operational amplifier 12, the negative input of which is connected to the junction between bridge resistors R1 and R2. The operational amplifier 12 includes a resistor R5 in feedback connection from the output to the negative input thereof. The output of amplifier 12 is connected to one lead of a plurality of potentiometers 14*a*, 14*b*, 14*c*, the adjustable contacts of which provide temperature compensating voltages for application to respective points in a circuit being thermally compensated. The output of amplifier 12 is also connected via a resistor R6 to the negative input of an inverter 16 which also includes a resistor R7 connected between the output and the negative input thereof. The positive input of inverter 16 is connected to ground. The output of inverter 16 is connected to the other lead of the plurality of potentiometers 14*a*, 14*b* and 14*c*.

Figure 2:
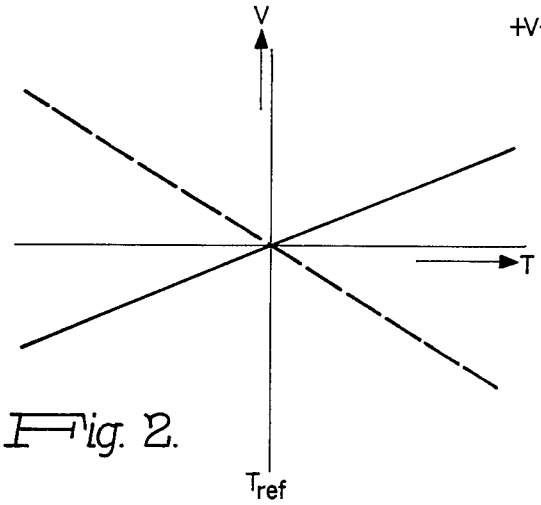
FIG. 2 is a plot of reference voltages provided by the circuit of FIG. 1.

The voltage versus temperature response of amplifier 12 and inverter 16 are as shown in FIG. 2, the solid curve being the voltage response of amplifier 12, the dotted curve being the voltage response of inverter 16. At a reference temperature (Tref), typically the room temperature of an operating circuit, the output voltage of amplifier 12 and of inverter 16 is zero. The respective positive and negative voltages provided by amplifier 12 and inverter 16 are of equal but opposite characteristics. For any given temperature above the reference temperature sensed by diode D1 of bridge network 10, amplifier 12 will provide a corresponding positive voltage, while inverter 16 will provide a corresponding negative voltage, equal in magnitude to the positive voltage of amplifier 12 but of opposite sense. For operating temperatures less than the reference temperature, amplifier 12 and inverter 16 can be implemented to provide corresponding negative and positive voltages corresponding thereto. The reference voltages provided by amplifier 12 and inverter 16 are substantially linear over the range of thermal variation encountered in practice. Correction voltages are derived from the potentiometers 14*a*, 14*b* and 14*c*, each being adjusted to be of magnitude and sense necessary to correct for a respective temperature error at a corresponding point in an operating circuit.

According to the invention, the actual operating temperature for which correction is to be provided need not be measured or even ascertained. At room or other reference temperature, the potentiometer R4 of the bridge network 10 is adjusted to provide a null output from amplifier 12 and inverter 16. At an elevated temperature, the potentiometer 14 associated with a circuit parameter to be compensated is adjusted until the correction voltage produced by that potentiometer yields the intended parameter value. Similarly, each other temperature sensitive parameter is adjusted by the corresponding potentiometers 14 until each of the parameters is within intended specification. The actual temperature for which correction is achieved and the actual amount of parameter drift need not be known since the correction voltages are each simply varied by the respective correction potentiometers until the intended parameter values are reached.

Figure 3:
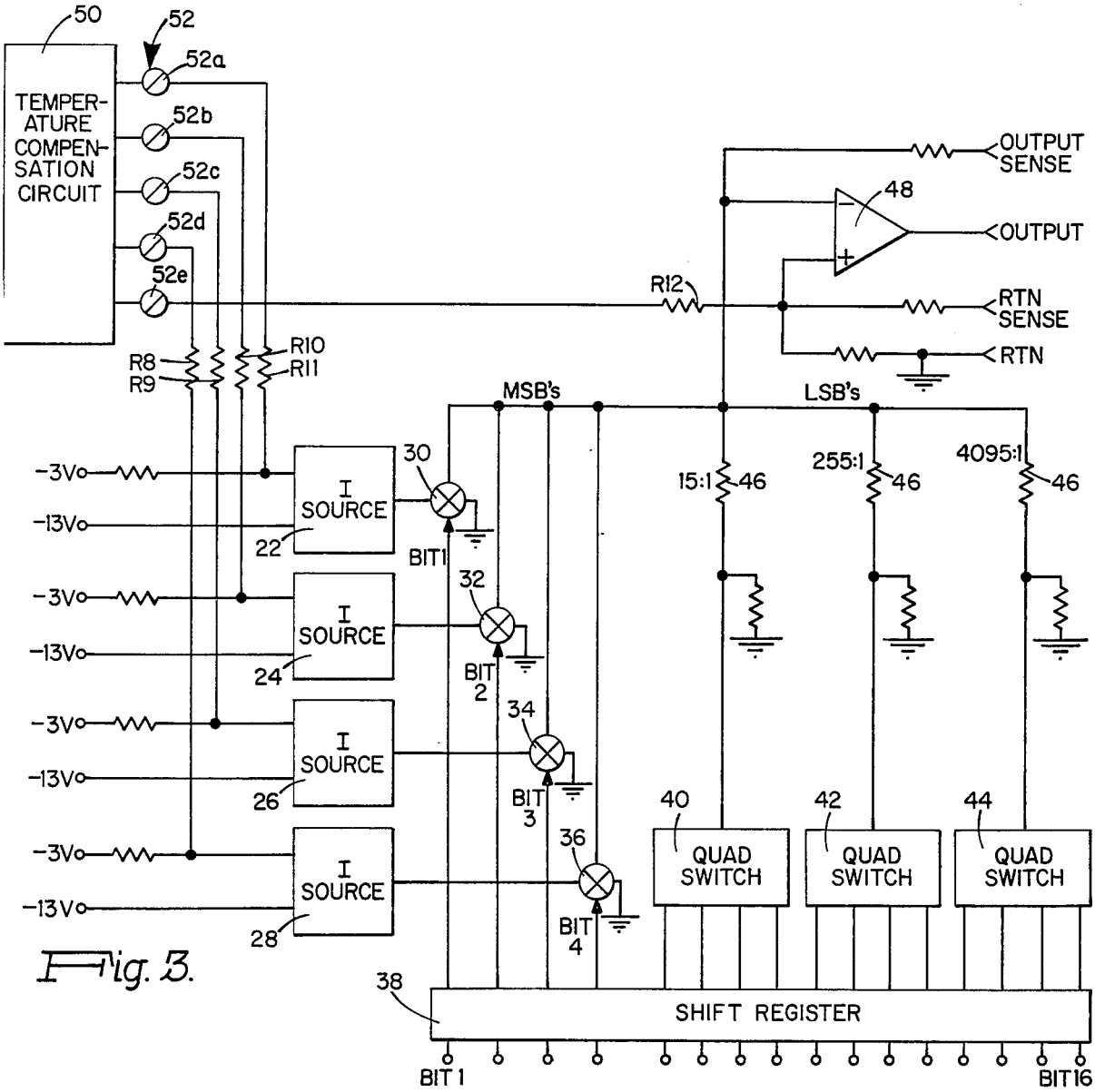
FIG. 3 is a schematic representation of a digital-to-analog converter employing temperature compensation according to the invention.

A digital-to-analog converter thermally compensated according to the invention is shown in FIG. 3. The converter circuit is itself known in the art and in the illustrated version employs a 16 bit digital input signal. Reference voltages, in this illustrated circuit being −3 and −13 volts, are applied to four controllable current sources 22, 24, 26 and 28 which, in turn, are coupled to respective low leakage diode current switches 30, 32, 34 and 36 which are controlled by corresponding outputs of a shift register 38. The switches are selectably connectable as a most significant bit (MSB) input to output amplifier 48 or to ground. Other outputs of shift register 38 are coupled to quad switches 40, 42 and 44. The outputs of the quad switches are coupled via weighting resistors 46 as a least significant bit (LSB) input to output amplifier 48.

A temperature compensation circuit 50 such as described above includes a plurality of potentiometers 52, the adjustable taps of which are coupled to respective points of the converter circuit at which thermal compensation is to be provided. Four potentiometers 52*a*–52*d* are respectively connected to current sources 22 through 28 by a corresponding resistor R8–R11. The potentiometer 52*e* is connected via a resistor R12 to output amplifier 48 as shown. By operation of the novel temperature compensation technique, each of the four most significant bit currents is compensated for temperature variation by addition of the correction voltage to the reference voltage. In like manner, the output amplifier is compensated for gain and offset variation. In providing the intended thermal compensation, the temperature compensation circuit 50 is adjusted as described above to provide a null output at room or other reference temperature. At an elevated operating temperature of the converter circuit, each potentiometer 52 is adjusted to provide a correction voltage to yield the intended value of the corresponding circuit parameter. The presence of the thermal compensation circuit does not affect the operating circuit to any material extent even if the compensation circuit is not yet adjusted to provide the desired temperature compensation.

The invention is not to be limited by what has been particularly shown and described except as indicated in the appended claims.

What is claimed is:

1. For use in apparatus in which electrical response is a function of temperature, a temperature compensation system comprising:

first means having a positive temperature characteristic for providing a first reference voltage positively increasing with temperature;

second means having a negative temperature characteristic equal and opposite to that of said first means for providing a second reference voltage negatively increasing with temperature;

said first and second reference voltages having a null value at a predetermined reference temperature; and means for deriving at least one correction voltage from both said first and second reference voltages of a magnitude and sense to correct for particular temperature error.

2. The invention according to claim 1 wherein said last named means includes a plurality of means for deriving respective correction voltages from both said first and second reference voltages, each of a magnitude and sense to correct for a corresponding temperature error.

3. A temperature compensation system comprising:

temperature sensing means providing an output signal representative of operating temperature;

amplifier means operative in response to the output signal of said temperature sensing means to provide a first reference voltage of substantially linear form positively increasing with temperature;

inverter means coupled to said amplifier means for providing a second reference voltage of substantially linear form negatively increasing with temperature and of equal and opposite temperature characteristic to that of said first reference signal;

means for adjusting said output signal to provide a null value of said first and second reference voltages at a predetermined reference temperature; and at least one potentiometer means for deriving at least one correction voltage from both said first and second reference voltages of a magnitude and sense to correct for a corresponding temperature error.

4. The invention according to claim 3 wherein said temperature sensing means includes:

a bridge circuit having a thermally sensitive element in one arm thereof.

5. The invention according to claim 3 wherein said potentiometer means includes:

a plurality of potentiometers for deriving respective correction voltages from both said first and second reference voltages each of a magnitude and sense to correct for a corresponding temperature error.

6. The invention according to claim 5 further including:

means for connecting each of said potentiometers to a respective point of an operating circuit at which temperature compensation is to be provided.

7. A method of temperature compensation comprising the steps of:

sensing an operating temperature;

producing a first reference signal positively increasing with temperature and having a predetermined null value at a selected reference temperature;

producing a second reference signal negatively increasing with temperature and of equal and opposite temperature characteristic to that of said first reference signal and having the same predetermined null value at said selected reference temperature; and deriving from said first and second reference signals at least one correction signal of a magnitude and sense to correct for a corresponding temperature error.

8. The invention according to claim 7 wherein said first and second reference signals are of substantially linear form over an intended operating range.

9. The invention according to claim 7 further including the step of:

applying said at least one correction signal to a predetermined point of an associated circuit at which temperature compensation is to be provided.

* * * * *